United States Patent [19]

Franz et al.

[11] 4,091,128

[45] May 23, 1978

[54] ELECTROLESS GOLD PLATING BATH

[75] Inventors: Helmut Franz, Pittsburgh; James C. Vanek, New Kensington, both of Pa.

[73] Assignee: PPG Industries, Inc., Pittsburgh, Pa.

[21] Appl. No.: 731,053

[22] Filed: Oct. 8, 1976

[51] Int. Cl.[2] ..... C23C 3/02

[52] U.S. Cl. ..... 427/304; 427/168; 427/426; 106/1.26; 427/430 A

[58] Field of Search ..... 427/304, 125, 437, 168, 427/169, 430 A, 426; 106/1, 1.23, 1.26; 428/457

[56] References Cited

U.S. PATENT DOCUMENTS

| | | | |
|---|---|---|---|
| 2,874,072 | 2/1959 | Cahill et al. | 427/437 |
| 2,969,295 | 1/1961 | Crishal et al. | 106/1 |
| 3,032,436 | 5/1962 | Gostin | 106/1 X |
| 3,266,929 | 8/1966 | Lareau et al. | 106/1 |
| 3,300,328 | 1/1967 | Luce | 106/1 |
| 3,396,042 | 8/1968 | Duva | 427/304 |
| 3,484,263 | 12/1969 | Kushihashi et al. | 106/1 |
| 3,515,571 | 6/1970 | Levy | 106/1 |
| 3,589,916 | 6/1971 | McCormack | 427/304 |
| 3,697,296 | 10/1972 | Bellis | 106/1 X |
| 4,005,229 | 1/1977 | Miller et al. | 427/304 |

*Primary Examiner*—Ralph S. Kendall
*Attorney, Agent, or Firm*—Donna L. Seidel

[57] ABSTRACT

A method for preparing an electroless gold plating bath comprising a gold salt and a complexing agent is improved by adding the gold salt as a concentrated solution to a concentrated solution of the complexing agent either maintained at or subsequently heated to above ambient temperature in order to eliminate the step of aging the plating bath. The plating efficiency of an electroless gold plating bath comprising a gold salt and an alkali carbonate complexing agent and the quality of the resulting gold film are improved by buffering the bath with an alkali metal bicarbonate thus maintaining a pH between about 8.5 to about 9.5.

9 Claims, No Drawings

ELECTROLESS GOLD PLATING BATH

CROSS-REFERENCE TO RELATED APPLICATIONS

The present invention is an improvement upon the general method disclosed in the patent application of Miller et al., U.S. Ser. No. 589,234 filed June 23, 1975, now U.S. Pat. No. 4,005,229, entitled "Novel Method for the Rapid Deposition of Gold Films onto Nonmetallic Substrates at Ambient Temperatures."

BACKGROUND OF THE INVENTION

1. Field of the Invention

The present invention relates broadly to the art of electroless deposition of metallic films onto non-metallic substrates. More particularly the invention relates to improving the method of preparation and the plating efficiency of an electroless gold plating bath for the deposition of uniform gold films on glass.

2. Description of the Prior Art

In the art of depositing noble metal coatings onto metallic surfaces, U.S. Pat. No. 2,969,295 discloses adding potassium gold cyanide to a sodium bicarbonate solution, heating the solution to facilitate more rapid plating, and immersing metallic bodies. Chemical plating occurs because of the tendency for metals lower in the electromotive force series to displace noble metal ions from the plating solution.

In the art of depositing noble metal coatings onto non-metallic surfaces, U.S. Pat. No. 3,300,328 to Luce discloses an aqueous electroless gold plating bath comprising a gold compound, an ammonium or alkali metal sulphite or meta-bisulphite complexing agent, and a hydrazine or hydroxylamine reducing agent. Gold films are deposited in about 40 minutes at elevated temperatures.

A more rapid method of depositing gold films onto non-metallic substrates is described by Levy in U.S. Pat. No. 3,515,571. A preferably neutral gold solution is prepared by dissolving in water a gold salt such as gold chloride, then complexing the free gold ions in excess of $10^{-16}$ gram ions per liter by suitable coordinating ligands such as alkali metal carbonates, alkali metal hydroxides, ammonia and amines. Levy emphasizes the importance of mixing the ingredients in the following manner. First, gold salt is dissolved in water and neutralized with sodium hydroxide. Next, the ligand is dissolved in water and neutralized with an acid. Finally, the gold salt solution and ligand solution are mixed together to form a final neutral gold plating solution. Gold films may be deposited on non-metallic substrates in about 1 minute at ambient temperatures by contacting a receptive surface with the above final gold solution and a second solution of a hydrazine reducing agent. Levy suggests the use of the resultant gold coated articles as conductors, electrodes, and mirrors.

U.S. Pat. No. 3,484,263 to Kushihashi et al. discloses a method for forming a homogeneous semi-transparent gold coating on glass. The method involves contacting a sensitized glass surface with an alkaline aqueous solution of a gold salt, a reducing agent and an alkali carbonate to promote reduction at a temperature not to exceed 10° C. After about 0.5 to 5 minutes contact, the contacting interface is subjected to radiation of 2500–5000 Angstroms to reduce the gold salt to a gold coating with a thickness of 150–500 Angstroms.

In U.S. Pat. No. 589,234, filed on June 23, 1975, now U.S. Pat. No. 4,005,229, Miller et al. disclose an improved method for the rapid deposition of uniform transparent gold films on non-metallic substrates such as glass. The method involves contacting an activated surface with an aqueous solution of a gold salt and a complexing agent in the presence of a hydrazine or hydroxylamine reducing agent. The improvement concerns aging the gold solution and contacting the surface in the presence of divalent mercury, cadmium or lead ions in order to enhance the uniformity of the gold films, an extremely important consideration if the coated articles are to be used in architectural applications.

The present invention provides a fast, simple, commercially practicable method of depositing gold films on non-metallic substrates such as glass and further provides alternative methods for improving the uniformity of such films for aesthetically pleasing coated articles having excellent solar energy control properties.

SUMMARY OF THE INVENTION

Uniform gold films are deposited on non-metallic substrates such as glass or plastics, which may be made receptive of a metallic coating, in the production of aesthetically pleasing coated articles having high solar energy reflectance. The method of deposition is electroless and sufficiently rapid to be adapted to a continuous, high-speed production line.

The substrate to be coated is cleaned, sensitized and activated by methods common in the art of electroless deposition. Representative methods are described in U.S. Pat. No. 3,457,138 to Miller. The gold film is deposited by contacting the receptive surface of the substrate substantially simultaneously with a gold solution and a reducing agent for the gold ions.

The gold solution comprises water, a gold compound and a complexing agent such as disclosed by Miller et al. in U.S. Ser. No. 589,234 filed on June 23, 1975 which is incorporated herein by reference. The present invention provides a method for preparing the gold solution which eliminates the need to age the gold solution prior to use to insure uniformity of the resultant film. The method of the present invention involves preparing a concentrated solution of the gold compound and a separate solution of the complexing agent and adding the gold solution to the complexing solution. In one embodiment of the present invention, the complexing solution is maintained at a temperature of about 130° –150° F. Alternatively, the gold solution may be added to the complexing solution at ambient temperature and the final solution heated to about 130° –150° F. The resultant gold-complexer solution is suitable for immediate use in the deposition of uniform gold films.

The present invention further embodies an improvement in the method of depositing gold films from a solution containing a gold compound and an alkali metal carbonate complexing agent. The improvement comprises buffering the gold-complexer solution with an alkali metal bicarbonate lowering the pH to about 8.5 to 9.5. The gold films deposited from the buffered gold solution are smoother in texture and superior in uniformity and optical quality compared with gold coatings deposited from more alkaline solutions. In addition, transparent coated articles prepared according to this method appear more "pure gold," i.e., more yellow-gold, than gold films deposited at higher pH and appear greenish yellow, rather than blue, in transmittance.

DETAILED DESCRIPTION OF THE PREFERRED EMBODIMENTS

Sheets of glass, particularly soda-lime-silica glass having a thickness of about 7/32 inch, are prepared for coating. First, the surface to be coated is cleaned, preferably by a blocking operation carried out with rotating felt blocks which gently abrade the surface with an aqueous slurry of a commercial cleaning compound. A suitable continuous line apparatus for washing, rinsing and sweeping the surface is shown in U.S. Pat. No. 3,723,158 to Miller et al.

After the surface to be coated is cleaned, it is contacted with a dilute aqueous solution of a sensitizing agent, preferably stannous chloride. After a brief period of contact under ambient conditions, the sheet is rinsed, preferably with deionized water, and activated. Activation may be accomplished by contacting the sensitized surface with a dilute solution of palladium chloride. Alternatively, the sensitized surface may be activated by the deposition of a thin catalytic metal film, preferably a silver film of sufficient thickness to lower the luminous transmittance of the sheet to from about 60 percent to as low as about 20 percent. Thicker silver films may be overcoated with gold according to the method of the present invention; however, the coated sheet will appear gold in reflection from the film side and silver in reflection from the glass side rather than gold in reflection from both sides as preferred.

The preferred method of activation is to contact the sensitized surface substantially simultaneously with a silver solution and a reducing solution. The silver solution preferably comprises about 0.15 to 15 grams silver nitrate, up to about 15 grams sodium hydroxide and about 0.45 to 60 milliliters of 28 to 30 percent ammonium hydroxide solution per liter of water. The reducing solution comprises about 0.5 to 10 grams of reducing agent, preferably dextrose, per liter of water. The activated surface is rinsed and is then ready for deposition of the gold film.

A concentrated gold solution is prepared by dissolving the selected amount of gold compound in about 1/10 the desired final volume of water and adding it, with stirring, to a similarly prepared complexing solution. The mixing of the solutions may occur at ambient temperature with the final solution being subsequently heated before or after dilution to final volume. It is preferred, however, that the concentrated complexing solution be maintained at an elevated temperature, preferably above 100° F. and more preferably about 130° to 150° F., while the concentrated gold solution is added. The plating solution is then suitable for use immediately after diluting the mixture to the desired final volume.

In a most preferred embodiment, the above procedure is carried out with a gold solution comprising about 1 to 6 grams per liter (final volume) gold chloride and a complexing solution comprising about 6 to 36 grams per liter (final volume) sodium carbonate. In the aqueous gold chloride solution a gold-chlorocomplex is initially formed. In the presence of the complexing agent, chloride ions are replaced by carbonate ions in an exchange reaction. However, in dilute solutions or at ambient temperature, concurrent reactions such as hydrolysis with the formation of insoluble black hydrolysis products, presumably gold hydroxychloride, hydroxide or oxide, which are detrimental to bath stability and plating consistency, can interfere with the formation of the relatively stable carbonate complex.

By stirring the concentrated gold solution into a concentrated carbonate solution at above-ambient temperatures, the gold-carbonate complex is formed essentially instantaneously, and undesirable side reactions are eliminated. In this most preferred embodiment, the uniformity and optical quality of the gold film may be further improved by adding to the plating solution sufficient bicarbonate to buffer the solution at a pH of about 8.5 to 9.5.

The growth mechanism for the gold film appears to differ between deposition from a plating solution of pH about 10.3 to 10.5 without the bicarbonate and pH about 9.0 with the bicarbonate. Without limiting the scope of the present invention, the following explanation is offered. The gold film deposited at the lower pH appears more like "pure gold" that is, more yellow and brightly metallic than gold films deposited at the higher pH. It appears that at the lower pH gold films are deposited in a smooth lateral growth pattern resulting in a highly reflective bright appearance, while, at the higher pH, local poisoning of film growth centers results in an acicular or dentritic outward type growth pattern with lower reflectivity and darker color.

Moreover, buffering the plating solution at pH 8.5 to 9.5 with bicarbonate especially improves the color and optical reproducibility of gold coatings deposited over a silver activation film. Again without limiting the scope of the present invention, the following explanation is proposed. At the higher pH, some slight but variable amount of the catalytic silver film is eroded before the gold film is deposited. At the lower pH, dissolution of the silver does not occur and the ratio of gold to silver can be more accurately controlled thus improving the reproducibility of the color and appearance of the gold films.

In addition, lowering the pH of the gold plating solution results in the unexpected advantage of extending the plating life of the solution thus facilitating deposition of gold films of lower luminous transmittance in a single coating operation. Other unexpected advantages are that the concentrations of the reducing agent and complexing agent can be reduced without deterioration of film quality or alteration of the plating rate and that peeling of the film during long plating times is eliminated.

The gold plating solution is preferably applied to the activated surface substantially simultaneously with an aqueous solution of a reducing agent, preferably hydrazine tartrate or hydrazine sulfate at a concentration of about 0.5 to 5 and preferably about 1 gram per liter. Contacting of the activated surface with the gold-complex and reducing agent at ambient temperature may continue for a period of from a few seconds to a few minutes. While the gold films disclosed by Miller et al. in U.S. Ser. No. 589,234, filed June 23, 1975, now U.S. Pat. No. 4,005,229 and incorporated herein by reference, reached a minimum luminous transmittance of about 15 percent in less than 1 minute, gold plating according to the method of the present invention may extend for more than 3 minutes and can produce gold coated articles having a luminous transmittance of 2 percent.

The present invention will be further understood from the descriptions of specific examples which follow:

EXAMPLE I

Glass sheets are cleaned with a commercial cleaning compound and rinsed thoroughly with demineralized water. The surface to be coated is then contacted with a dilute aqueous solution of stannous chloride for sensitization. After rinsing, the sensitized surface is activated by contacting it substantially simultaneously with a silver salt solution and a reducing solution to deposit a catalytic silver film decreasing the luminous transmittance to about 25 percent.

A gold solution is prepared by dissolving 2 grams of gold chloride in about 100 milliliters of water. A complexing solution is prepared by dissolving 12 grams of sodium carbonate in about 100 milliliters of water. The complexing solution is then heated to about 150° F. and stirred continuously while the gold solution is added. The gold complex solution is diluted to 1 liter and is then suitable for immediate use. The pH of the gold-complex solution is about 10.3. A reducing solution is prepared by dissolving 2 grams of hydrazine tartrate in a liter of water.

The gold-complex and reducing solutions are then sprayed substantially simultaneously onto the activated glass surface. The luminous transmittance initially increases to about 32 to 35 percent as part of the silver film is eroded before deposition of the gold film begins. After about 40 seconds contact, a uniform gold film of maximum thickness, as estimated from the transmittance, is deposited on the glass surface with no mottle or streaking. The coated article appears gold by reflection and blue by transmission and has a final luminous transmittance of about 16 percent.

EXAMPLE II

Glass sheets are cleaned, sensitized and activated as in Example I. A gold-complex solution is prepared as in Example I and after dilution to final volume, 6 grams of sodium bicarbonate is added which buffers the gold-complex solution at a pH of about 9.4 The activated glass surface is then contacted substantially simultaneously with the gold-complex solution and a reducing solution as described in Example I. A gold film is deposited at a slightly increased plating rate with no erosion of the catalytic silver film and the plating time is extended to about 60 to 70 seconds. A uniform gold film of maximum thickness, as estimated from the transmittance, is deposited on the glass surface resulting in a coated article with a final luminous transmittance of about 8 percent.

EXAMPLE III

Glass sheets are cleaned, sensitized and activated as in Example I. A gold-complex solution is prepared as in Example I and after dilution to final volume, 30 grams of sodium bicarbonate is added which buffers the gold-complex solution at a pH of about 9.0. The activated glass surface is then contacted substantially simultaneously with the gold-complex solution and a reducing solution as described in Example I. A gold film is deposited at a significantly increased plating rate with no erosion of the catalytic silver film and the plating time is extended to about 80 seconds. A uniform gold-coated article is produced.

EXAMPLE IV

A gold-coated glass article is prepared as described in Example III except that the concentration of hydrazine tartrate in the reducing solution is decreased to 1.0 gram per liter. No decrease in plating rate nor deterioration of film quality and color is observed. Moreover, there is no peeling of the gold film for up to 3 minutes exposure to the plating bath.

EXAMPLE V

A gold-coated glass article is prepared as described in Example IV except that hydrazine sulfate is substituted as the reducing agent. No deleterious effects are observed from the substitution of the less expensive reducing agent.

EXAMPLE VI

A gold solution is prepared as in Example I and is added with stirring to a concentrated complexing solution of 6 grams sodium carbonate in 100 milliliters of water maintained at a temperature of about 130° F. The gold-complex solution is then diluted to one liter and 30 grams of sodium bicarbonate is added which buffers the gold-complex solution at a pH of about 8.7. A glass surface is cleaned, sensitized and activated as in Example I and then contacted substantially simultaneously with the above gold-complex solution and a reducing solution of 1.0 gram per liter hydrazine sulfate. After 3 minutes contact, a uniform gold film is deposited on the glass surface with no peeling of the film. The final luminous transmittances of the coated article is about 2 percent.

EXAMPLE VII

Glass sheets are cleaned and sensitized as in Example I. The sensitized surface is activated with a dilute aqueous solution of palladium chloride. The activated surface is then contacted with gold-complex and reducing solutions as in Example III. After about 80 seconds contact, a uniform gold film of maximum thickness, as estimated from the transmittance, is deposited. The gold-coated article appears yellow-gold by reflection and greenish-yellow by transmission and has a luminous transmittance of about 37 percent.

The above examples are offered only to illustrate the present invention. Various modifications which will become apparent to ones skilled in the art are included within the spirit of the invention, the scope of which is limited only as set forth in the claims.

We claim:

1. In a method for preparing a gold film on a non-metallic substrate comprising the steps of sensitizing and activating a surface of the substrate and contacting the activated surface with an aqueous solution of a gold salt and a complexing agent in the presence of a reducing agent, the improvement which comprises preparing the aqueous solution of a gold salt and a complexing agent by (a) adding the gold salt to a volume of water substantially less than half the desired final volume of the aqueous solution but sufficient to dissolve the gold salt;

(b) adding the complexing agent to a volume of water substantially less than half the desired final volume of the aqueous solution but sufficient to dissolve the complexing agent;

(c) adding the solution prepared in (a) to the solution prepared in (b);

(d) diluting the aqueous solution prepared in (c) to the desired final volume; and (e) heating a solution comprising the complexing agent to substantially accelerate the complexation reaction.

2. The improved method according to claim 1, wherein step (e) is carried out subsequent to step (d) by heating the aqueous solution of gold salt and complexing agent to a temperature of at least about 100° F.

3. The improved method according to claim 2, wherein step (e) is carried out by heating the aqueous solution to a temperature of about 130° to 150° F.

4. The improved method according to claim 1, wherein step (e) is carried out prior to step (d) by heating the aqueous solution of gold salt and complexing agent to a temperature of at least about 100° F.

5. The improved method according to claim 4, wherein step (e) is carried out prior to step (d) by heating the aqueous solution to a temperature of about 130° to 150° F.

6. The improved method according to claim 1, wherein step (e) is carried out simultaneously with step (c) by maintaining the complexing solution prepared according to step (b) at a temperature of at least about 100° F. prior to the addition of the gold solution.

7. In an improved method according to claim 1, wherein the complexing agent is sodium carbonate, the further improvement which comprises adding to the aqueous solution of gold salt and complexing agent sufficient sodium bicarbonate to buffer the solution at a pH of between about 8.5 and about 9.5.

8. In a method for preparing a gold film on a non-metallic substrate comprising the steps of sensitizing and activating a surface of the substrate and contacting the activated surface substantially simultaneously with a first aqueous solution comprising from about 1 to about 6 grams per liter gold chloride and about 6 to about 36 grams per liter complexing agent and a second aqueous solution comprising from about 0.5 to about 5 grams per liter of a hydrazine or hydroxylamine reducing agent the improvement which comprises preparing the first aqueous solution by (a) dissolving the gold chloride in water about 1/10 the desired final volume of the aqueous solution;

(b) dissolving the complexing agent in the water about 1/10 the desired final volume of the aqueous solution;

(c) heating the solution prepared according to step (b) to a temperature of about 130° to about 150° F.;

(d) adding the solution prepared in step (a) to the heated solution of step (c); and (e) diluting the solution prepared in step (d) to the desired final volume.

9. In an improved method according to claim 8, wherein the complexing agent is sodium carbonate, the further improvement which comprises adding to the aqueous solution of gold salt and complexing agent sufficient sodium bicarbonate to buffer the solution at a pH of between about 8.5 and about 9.5.

* * * * *